US006286241B1

(12) United States Patent
Constant et al.

(10) Patent No.: US 6,286,241 B1
(45) Date of Patent: Sep. 11, 2001

(54) FIRING CONTROL SYSTEM FOR NON-IMPACT FIRED AMMUNITION

(75) Inventors: Robert L. Constant, Westfield; David J. Petig, Ludlow; John F. Klebes, Feeding Hills; Craig A. Mariani, Ludlow; Richard Mikuta, Easthampton, all of MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/205,391

(22) Filed: Dec. 4, 1998

(51) Int. Cl.[7] ..... F41A 19/00
(52) U.S. Cl. ..... 42/84
(58) Field of Search ..... 42/84; 89/135, 89/127, 28.05

(56) References Cited

U.S. PATENT DOCUMENTS

| | | | | |
|---|---|---|---|---|
| 3,650,174 | | 3/1972 | Nelsen | 89/28 |
| 4,329,803 | * | 5/1982 | Johnson et al. | 42/84 |
| 4,467,545 | | 8/1984 | Shaw, Jr. . | |
| 4,730,407 | * | 3/1988 | DeCarlo | 42/84 |
| 4,793,085 | | 12/1988 | Surawski et al. . | |
| 4,970,819 | | 11/1990 | Mayhak . | |
| 5,074,189 | | 12/1991 | Kurtz . | |
| 5,083,392 | | 1/1992 | Bookstaber . | |
| 5,272,828 | | 12/1993 | Petrick et al. . | |
| 5,303,495 | | 4/1994 | Harthcock . | |
| 5,448,847 | | 9/1995 | Teetzel . | |
| 5,459,957 | | 10/1995 | Winer . | |
| 5,625,972 | | 5/1997 | King et al. . | |
| 5,704,153 | | 1/1998 | Kaminski et al. . | |
| 5,755,056 | | 5/1998 | Danner et al. . | |
| 5,799,433 | | 9/1998 | Danner et al. | 42/1.05 |
| 5,806,226 | | 9/1998 | Norton et al. | 42/84 |
| 5,937,557 | | 8/1999 | Bowker et al. | 42/70.01 |
| 5,937,558 | | 8/1999 | Gerard | 42/84 |

* cited by examiner

*Primary Examiner*—Charles T. Jordan
*Assistant Examiner*—M Thomson
(74) *Attorney, Agent, or Firm*—McCormick, Paulding & Huber LLP

(57) ABSTRACT

A firearm for firing non-impact primer ammunition includes an electrically-conductive firing probe adapted to deliver a firing charge to ignite the primer and cause firing. The firing signal is controlled by a computer control system located in the firearm that determines firing ready conditions, including operator identification, and causes the firing signal to be delivered in response thereto.

21 Claims, 6 Drawing Sheets

FIRING CONTROL SYSTEM FOR NON-IMPACT FIRED AMMUNITION

RELATED APPLICATION

This application is related to a copending U.S. Patent application titled "A FIREARM HAVING AN INTELLIGENT CONTROLLER", application Ser. No. 09/206,013, filed on Dec. 4, 1998, which is commonly assigned to the owner of the present application.

FIELD OF THE INVENTION

The present invention relates to firearms and, more particularly, to firearms capable of firing non-impact fired ammunition through the use of direct energy, such as electrical energy.

BACKGROUND OF THE INVENTION

In conventional firearms, either a striker or a hammer and firing pin is provided for detonating percussion primers. Although numerous advances in firearm technology have been made over the years, the principle of ignition by impact is based on technology that was developed during the last century. The use of percussion primers and associated physical components in modern firearms has imposed constraints which have inhibited significant advances in safety, performance and reliability.

While various electronic components have been introduced into firearm ignition systems, such components have typically been implemented as substitute or supplemental parts of a mechanical firing system. Despite these implementations, the percussion primer is still typically detonated in the conventional manner by impact from a firing pin or a striker. For example, U.S. Pat. No. 4,793,085 discloses a firearm in which a mechanical trigger bar is displaced by a solenoid. U.S. Pat. No. 5,704,153 discloses a firearm incorporating a microprocessor in an ignition system for a firearm using a conventional percussion primer.

Some electrical firearms using unconventional primers have been developed, but with significant limitations. For example, U.S. Pat. No. 3,650,174 describes a hard-wired electronic control system for firing electrically primed ammunition, but the system lacks multiple interfacing capability and a central processing unit, which are both critical to versatility, maintenance and safety. U.S. Pat. No. 5,625,972 discloses an electrically fired firearm in which a heat sensitive primer is ignited by a voltage induced across a fuse wire extending through the primer. A laser ignited primer is disclosed in U.S. Pat. No. 5,272,828, wherein an optically transparent plug or window is centered in the case of the cartridge to permit laser ignition of the primer. In such a device, however, power requirements are substantial and limiting.

None of the prior art provide a firearm system that utilizes a non-impact primer and has enhanced features that improve safety, performance, versatility, modular compatibility, and durability in the manner associated with the present invention as will herein be described.

OBJECTS AND SUMMARY OF THE INVENTION

It is an object of the present invention to provide a safe, reliable, high-performance, modular firearm that uses electrical power to ignite a primer for firing.

It is an object of the present invention to provide a firearm that eliminates the need for cumbersome and wear-prone mechanical components for igniting ammunition primer.

It is an object of the present invention to provide an electronic firearm having multi-function capabilities attributable to an all-electric fire control system capable of interfacing with a variety of sensors and a central processing unit.

It is an object of the present invention to provide a firearm having enhanced reliability, efficient and simplified manufacturability, and competitive cost, inherently attributable to its modular design.

It is an object of the present invention to provide superior performance by eliminating mechanical components associated with conventional firing mechanisms which tend to pull a user's aim off target.

It is an object of the present invention to provide a firing and ignition system capable of transmitting a firing signal from a controller through circuitry connected to a battery and causing a firing pulse to be discharged in square wave form from a capacitor which retains stored energy.

It is an object of the present invention to provide a firing and ignition system capable of storing electrical energy at low voltages until needed.

It is an object of the present invention to provide a firearm that is adaptable for use with several types of ammunition, including electrically-fired ammunition, optically-fired ammunition, and other types of direct energy initiated ammunition.

The present invention attains these objects and other inherent advantages as described herein.

Currently available non-impact primers are reliable, electrically conductive primers. These non-impact primers have made possible the development and implementation of fully electronic, microprocessor-controlled firearms. Significant improvement in reliability and accuracy of powder ignition can be attained by eliminating the requirement for a mechanical impact force between the electronic control and the ammunition.

The present invention firearm ignites a non-impact primer through the use of an electrically-conductive ignition probe. The ignition probe is movably mounted within the slide of the firearm, and is spring biased into contact with an ammunition round positioned in the firing chamber, ensuring electrical contact therewith. A user selectively activates a switch which sends an electric signal through the ignition probe, thereby activating the electrically detonated primer.

DESCRIPTION OF THE PREFERRED EMBODIMENTS

Figure 1:
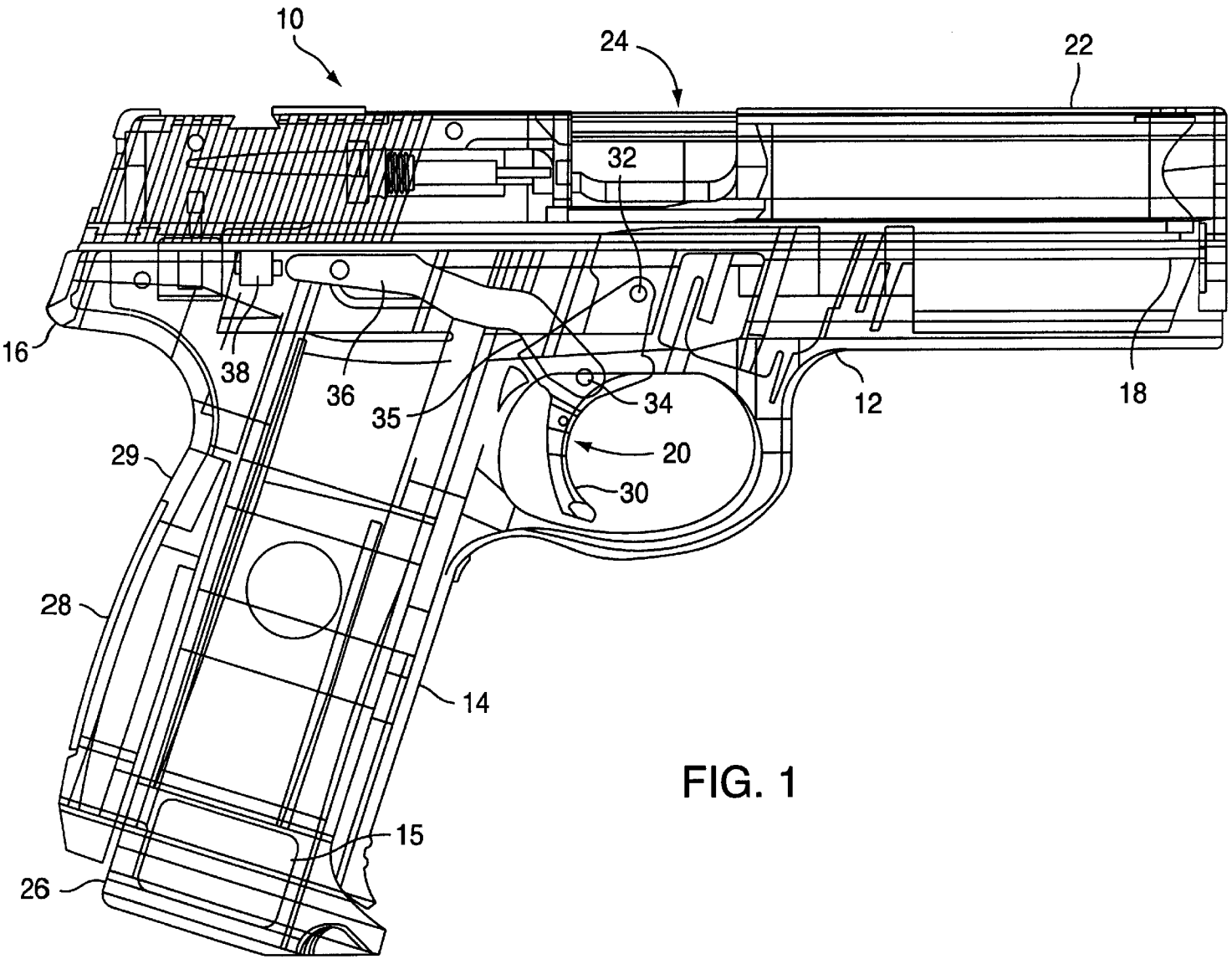
FIG. 1 is a schematic, cross-sectional side view of a first embodiment of the present invention firing system implemented in a semi-automatic pistol.

A first embodiment of a firearm of the present invention in the form of a semi-automatic pistol (10) is shown in FIG. 1 having a frame (12) comprising a grip (14), a rear end (16), a front end (18), and a trigger system (20). The pistol (10) further comprises a movable slide (22) and an ammunition round chamber (24). The frame (12) preferably comprises a unitary, polymer structure.

The grip (14) is adapted to receive a magazine (26) that contains ammunition rounds and other components of the pistol (10). If preferred, a battery (15) may be housed in the grip (14). The magazine (26) has conventional spring-biased ammunition loading mechanisms for advancing successive ammunition rounds into the ammunition firing chamber (24). As discussed below, the grip (14) is further adapted to receive a control module (28) in accordance with the present invention.

The slide (22) is mounted on top of the frame (12) in a conventional manner for reciprocal movement along the top of the frame (12) in response to the firing of an ammunition round housed in the firing chamber (24). As is generally known in the art, the reciprocal movement of the slide (22) corresponding to successive firing causes the interaction of mechanical components to extract the shell or casing of a fired ammunition round and discharge the cartridge out of the chamber (24). After firing and discharge of a spent casing, a new ammunition round is automatically chambered for firing, as the slide (22) is returned to its starting position.

The trigger system (20) includes a trigger lever (30) adapted to be activated by the finger of an operator. The trigger lever (30) pivots about a first pin (32) that is fixed with respect to the frame (12). A second pin (34) connects the trigger lever (30) to a trigger bar (36) which is adapted to be moved linearly with respect to the frame (12) in order to activate, through contact, a switch system (38) for causing delivery of a firing signal through a firing/ignition probe (50) as discussed below, to effect subsequent firing of the firearm (10).

Figure 2:
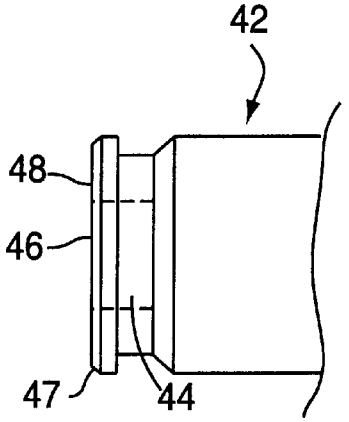
FIG. 2 is a schematic, partial view of the rear end of an ammunition round of the type utilized with the firing system of the present invention.

Referring to FIG. 2, the rear end of an ammunition round/cartridge (42) includes a non-impact primer (44), shown in phantom lines. The primer (44) is of a smaller diameter than the ammunition cartridge (42) and is concentrically aligned therewith. A non-impact primer such as the Conductive Primer Mix™ developed by Remington Arms Company and described in U.S. Pat. No. 5,646,367 may be used. The primer (44) is designed to detonate when an electric signal of a predetermined voltage is applied to it. The primer (44) is embedded in a proximal end (44) of the cartridge (42) so that the proximal end (46) of the primer (44) forms a slightly recessed contact surface therewith.

Figure 3:
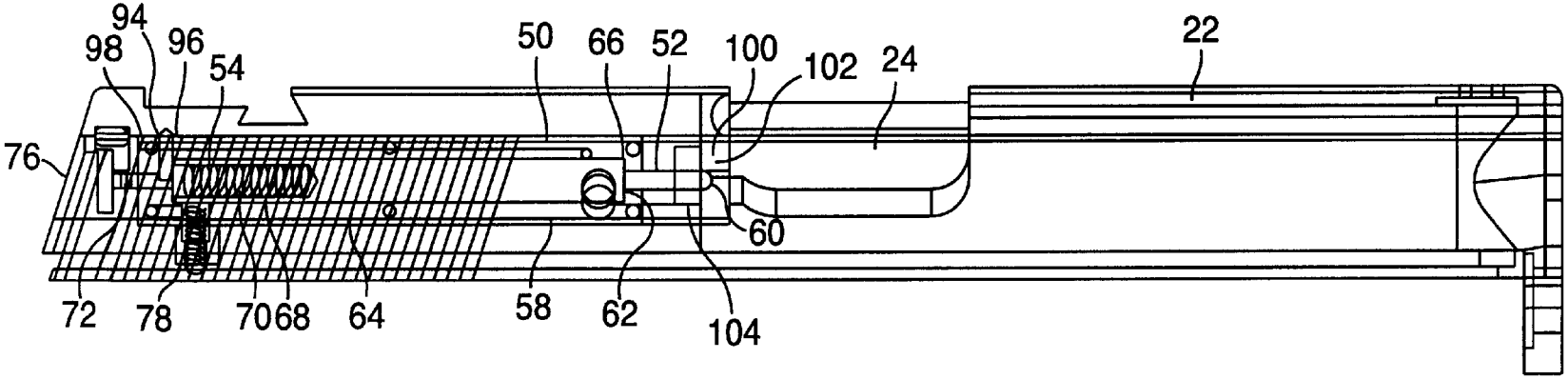
FIG. 3 is a schematic, partial, cross-sectional side view of a slide used with the pistol illustrated in FIG. 1.
Figure 4:
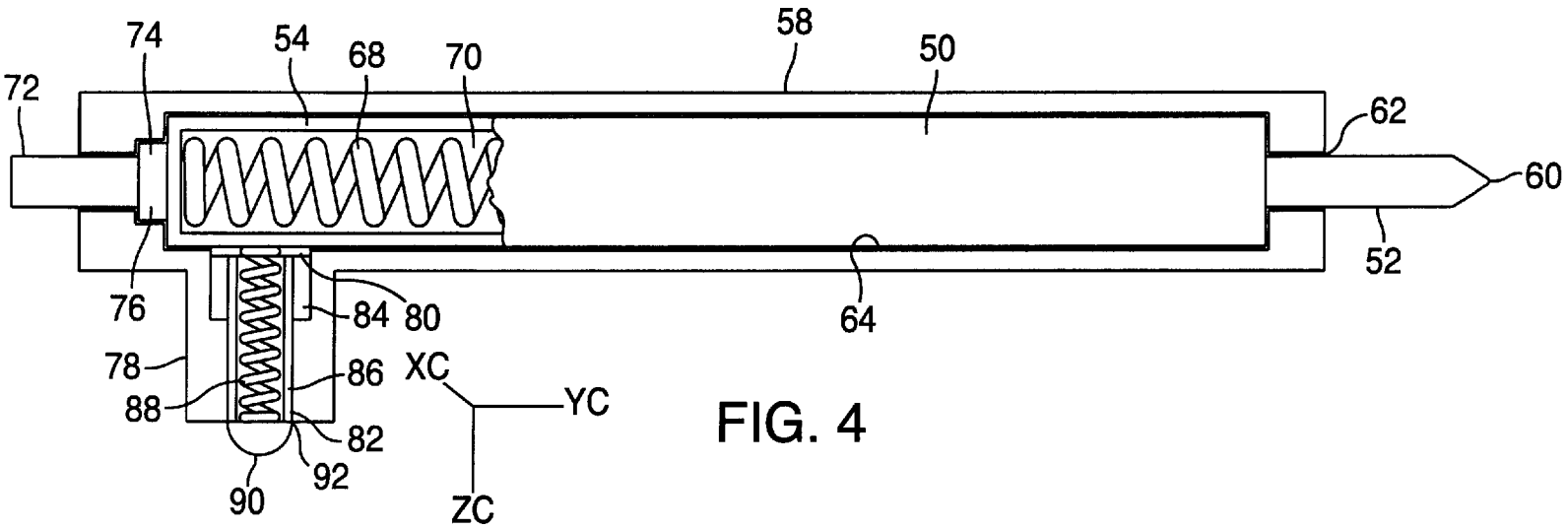
FIG. 4 is a schematic, partial, cross-sectional side view of a first embodiment firing probe assembly according to the present invention and utilized with the pistol illustrated in FIG. 1.

Referring to FIGS. 3–4, an electrically conductive ignition probe (50) in the form of an elongated member having a distal end (52) of a first diameter and a proximal end (54) of a second diameter, which is greater than the first diameter, is positioned within the rear end of the slide (22). The ignition probe (50) can be of any one of a variety of cross-sectional shapes, such as round as shown in the preferred embodiment. The ignition probe (50) is contained within an insulator sleeve (58) except for the tip (60) at the distal end thereof. The insulator sleeve (58) has a small diameter distal opening (62) at its distal end to allow the small diameter end (52) of the ignition probe (50) to protrude therefrom. The ignition probe (50) is adapted to slide within and relative to the electrical insulator sleeve (58) in a longitudinal direction. The insulator sleeve (58) has a large diameter interior chamber (64) that communicates with the small diameter opening (62) to accommodate the large diameter proximal end (54) of the ignition probe (50). A shoulder (66) is formed where the chamber (64) and opening (62) join, in order to limit forward axial movement of the ignition probe (50) beyond a predetermined point. The ignition probe (50) is positioned within the rear of the slide (22) behind the ammunition firing chamber (24). When an ammunition round (42) is positioned in the firing chamber (24) for firing, the end of the tip (60) engages the primer (44) in order to deliver an electric current thereto for sensing and firing of the ammunition cartridge (42). The ignition probe (50) is spring-biased relative to the insulator sleeve (58) in the longitudinal direction. In the preferred embodiment, a compression coil spring (68) is provided within an internal bore (70) in the proximal end of the ignition probe (50) that opens to the proximal end of the insulator sleeve interior chamber (64) so that the spring (68) biases the ignition probe (50) relative to the insulator sleeve (58). An insulator sleeve end plunger (72) is provided at the proximal end of the insulator sleeve (58) and it has a front section (74) of a diameter that enables it to fit into the internal bore (70) of the ignition probe (50). The end plunger (72) is fixed relative to the insulator sleeve (58) and the slide (22) by being fixed to a slide end piece (76). Because the compression spring (68) is not fully compressed in the resting position and there is space in the chamber (64) behind to the ignition probe (50), the ignition probe (50) has room to move rearwardly in the axial direction if sufficient force is applied against the compression spring (68). This feature enables positive contact between the probe tip (60) and the ammunition cartridge (42) when an ammunition cartridge (42) is loaded into the firing chamber (24), as will be explained below.

The insulator sleeve (58) has a downward facing extension (78) with an internal passage (80) that opens to the interior chamber (64). The internal passage (80) extends down and away from the longitudinal axis of the insulator sleeve (58). The internal passage (80) is in communication with the interior chamber (64) and allows a conductor member in the form of a telescopically expandable, spring-biased plunger (82) to be in contact with the ignition probe (50) as shown in FIGS. 3–4. The plunger (82) comprises two telescopically interfitting pieces (84,86) that have closed ends facing away from each other and open ends received by each other in telescoping fashion. A compression spring (88) is held inside to bias the two pieces (84,86) away from each other in linear expansion. The plunger (82) is positioned between the ignition probe (50) and an electrical contact (not shown) of the firing control circuit, such that the plunger (82) conducts the electric firing pulse to the ignition probe (50). The telescoping plunger (82) extends through the internal passage (80) wherein the tip (90) of the conductor protrudes out of an opening (92) in the end of the extension (78).

Alternatively, the plunger (82) could be a conductor member in the form of a body having two diameter sections including a greater diameter section at its proximal end and a lesser diameter at its distal end. The different diameter ends define a shoulder that cooperates with a shoulder formed in the internal passage. The conductor member is spring biased away from the ignition probe by means of a spring in a bore within the extension member. Upon maximum extension, the greater diameter section of the conductor member seats itself on the shoulder to limit extension and prohibit the conductor member from breaking contact with the ignition probe.

A ground member, preferably in the form of a spring-biased plunger (94), is positioned within a bore (96) in the slide (22) so that it contacts a surface (98) of the slide (22). The plunger (94) contacts the metal slide (22) to complete a ground. Alternatively, metal rails or inserts can be provided within the frame (12) to serve as ground contacts.

The use of spring-biased structures for the ground member and the conductive plunger (82) provides the benefits of modular construction and ensures reliable electrical contact while enabling convenient and safe removal and installation of parts for servicing or replacement.

The ignition probe (50) and insulator sleeve (58) assembly is positioned in the rear end of the slide (22) so that the ignition probe tip (60) protrudes through a hole (100) in an interior wall (102) of the slide (22) that is in communication with the firing chamber (24). A ceramic insulator bushing (104) having a central hole for slidably receiving the ignition probe tip (60) provides electrical insulation. The ceramic bushing (104) is provided with a hole that enables the probe tip (60) to pass through, yet the hole is a sufficiently close fit to prevent deformation of the primer (44) back into the bushing (104) during and after firing. In addition, the insulator bushing (104) helps to center and maintain the position of the ignition probe (50) concentrically in the internal bore of the slide (22). When the firing chamber (24) is empty, as shown in FIG. 3, the compression spring (68) biases the ignition probe (50) to its furthest forward position.

An ammunition cartridge (42) is introduced into the firing chamber (24) when the slide (22) is drawn back and positioned above the magazine (26), as is the case in conventional semi-automatic pistols. The ammunition round (42) is fed into the firing chamber (24) in a direction that is perpendicular to the axis of the slide (22). As the ammunition round (42) is fed into the firing chamber (24), the beveled edge (47) of the rear end (48) of the ammunition round (42) contacts the ignition probe tip (60). Because the ignition probe (50) is spring biased in the axial or longitudinal direction, camming action between the ignition probe tip (60) and the beveled edge of the ammunition round (42) cause the ignition probe (50) to move backward. The ignition probe (50) remains in contact with the ammunition round (42) while the ammunition round (42) is in the firing chamber (24). Because the rear surface of the ammunition round (42) has a dimple formed in the center where the primer (44) surface is exposed, the ignition probe tip (60) rests in the dimple.

It is critical that the probe tip (60) does not exert such force on the primer (44) that it causes deformation of the primer (44). In the preferred embodiment, the axial force exerted by the probe tip (60) on the primer (44) should not exceed two pounds. This force limit would vary depending upon a variety of parameters such as the strength characteristics of the specific ammunition used, the probe tip (60) geometry, and the material characteristics of the probe tip (60).

Of equal importance, is the ability for the spent ammunition casing to be ejected. For ejection, it is necessary that the probe tip (60) force and its geometry relative to the dimple in the primer (44) be selected so that a predetermined force applied to the casing perpendicular to the axis of the ignition probe (50) will cause the probe tip (60) to move axially relative to the dimple by camming action against the bias of the spring (114) so that the casing can be ejected.

For the intended performance described herein, the dimensions and geometry of the probe tip (60), as well as the spring force applied to the probe (50), will depend on the ammunition size and geometry and other parameters.

In the preferred embodiment, the components are sized and arranged so that the ignition probe tip (60) has a radius of approximately 0.020 inches and extends beyond the interior wall (102) of the slide (22) when it is in the firing position by a distance of approximately 0.040 inches. This ensures that there will be positive contact between the ignition probe tip (60) and the primer (44). The distance of rearward travel of the probe (50) is controlled to ensure that the ignition probe tip (60) will be nearly flush with the breech face of the internal wall (102) to provide support to the primer (44) upon ignition. The large diameter proximal end (54) of the ignition probe (50) moves longitudinally in the internal bore cavity (70) of the insulating sleeve (58) which is stopped by contact with the rear of the cavity (70). The compression spring (68) is selected and positioned to maintain a spring resistance, of approximately two pounds, which is sufficient so that when the ignition probe (50) is pushed backward by camming action associated with the insertion of an ammunition cartridge (42) the compression spring (68) force will not interfere with or prevent normal feeding of the ammunition cartridge (42) into the firing chamber (24). The force of the probe tip (60) is intended to enable the probe tip (60) and ammunition casing to rub during loading and unloading in such a manner to cause wiping or self-cleaning, thereby enhancing electrical contact properties.

Figure 5:
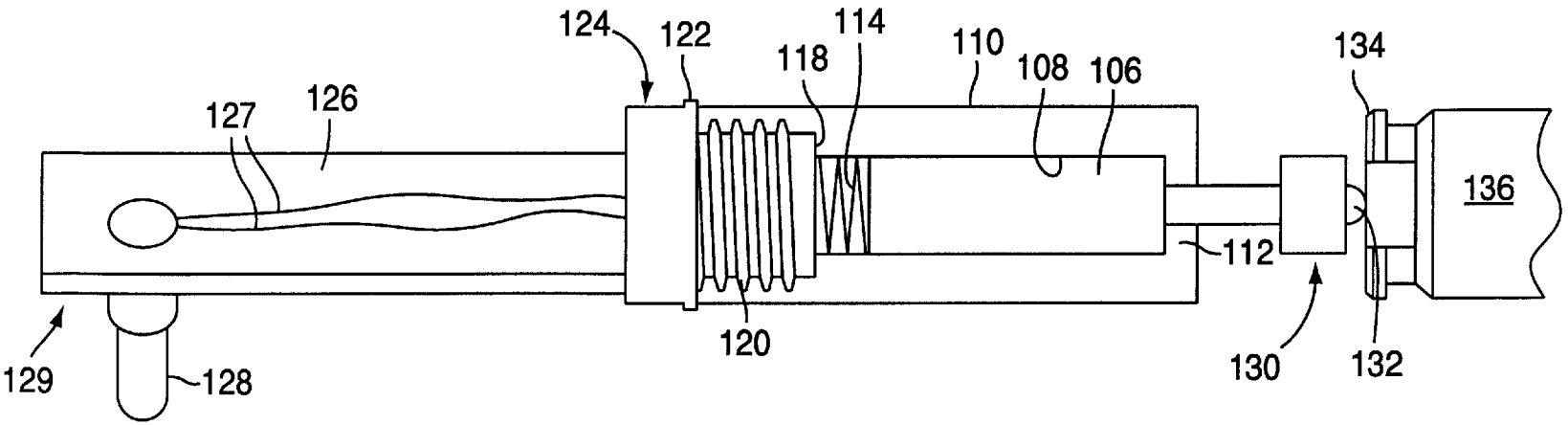
FIG. 5 is a schematic, partial, cross-sectional side view of a second embodiment firing probe assembly according to the present invention and utilized with the pistol illustrated in FIG. 1.

An alternative embodiment of the ignition probe and insulator sleeve assembly is illustrated in FIG. 5. An ignition probe (106) is spring biased within an internal passage (108) in an insulator sleeve (110) having an internal shoulder (112) for seating the ignition probe (106) in a manner similar to that described with respect to the embodiment described in associate with FIGS. 1–4. The compression spring (114) is positioned in an internal bore in the ignition probe (106) and is seated against the front wall (118) of an end cap (120) that seals the internal passage (108) at the rear end of the insulator sleeve (110). A retaining ring (122) is positioned behind the end cap (120) and a spacer (124) thereby providing radial stability for mounting in a slide. A rearwardly extending ignition board (126) leads to a conductor element (128) extending through an electrically insulating extension member (129), that is spring biased radially away from the longitudinal axis of the ignition probe (106). Various circuitry relating to firing control and conductor material (127) deposited on the ignition board (126) provide for one stage of a two-stage ignition firing system as described in the Co-Pending U.S. Patent Application (attorney docket number 5001A-228). In that embodiment, the firing impulse can by generated by a two-stage ignition system instead of the preferred embodiment capacitive discharge system. In the two-stage ignition system, the first stage is a pulse width modulated discontinuous dc-to-dc converter and the second stage is a pulse generator capable of generating pulses of sufficient voltage and duration to fire the electrically ignitable ammunition.

A ceramic insulating bushing (130) having a central hole therethrough receives the ignition probe tip (132) in a manner such that the tip (132) extends past the insulating bushing (130). In a similar manner as described above with respect to the embodiment illustrated in FIGS. 1–4, the ignition probe (106) is adapted to be moved backward in response to camming action between the probe (106) and the beveled rear edge (134) of an ammunition round (136) fed into the firing chamber of the pistol. The ceramic bushing (130) serves as an insulator and as a barrier against back pressure from primer ignition.

Returning to FIGS. 1–4, the ignition probe (50) is preferably made of hardened stainless steel or carbon steel. Alternatively, insulation can be provided around the ignition probe (50), as well as the ignition probe (106) of FIG. 5, by different means such as deposition or coating of the probe (50) with an insulating coating, such as ceramic or diamond film.

The electric current that provides the necessary charge to ignite the ignition primer (44) is carried through the conductor plunger (82) and the ignition probe (50), and delivered to the ignition primer (44). Electricity is provided from a set of two batteries. A non-rechargeable primary battery (15) housed in a magazine cooperates with a rechargeable secondary battery housed in the frame (12). If desired, another suitable power source may be utilized. The power source provides energy through control means and a circuit which are described in the copending U.S. Patent Application (Attorney Docket no. 5001A-228).

The trigger lever (30) pivots about the first pin (32) that is fixed with respect to the frame (12). The second pin (34) connects the trigger lever (30) to the first end (35) of the trigger bar (36) which is adapted to be moved linearly with respect to the frame (12) in order to activate, through contact, the switch system (38) for causing delivery of a firing signal through a firing probe (50), and subsequent firing of the firearm (10) which, in the preferred embodiment, includes a pair of contact switches. Two switches are used instead of one in order to reduce the possibility of a misfire by requiring redundant switching.

When the trigger lever (30) is pulled by the operator into the firing position, it pivots about the first pin (32) causing the trigger bar (36) connected to the trigger lever (30) to be displaced upwardly and rearwardly, so that the trigger bar (36) moves linearly in order to contact the switches of the switch system (38) to close the trigger control circuit and to enable electric current to be transmitted to the ignition primer (44). The trigger lever (30) is provided with a conventional spring to provide resistance to the operator's finger and to return the trigger to a start position after activation.

In accordance with the disclosure of copending U.S. Patent Application (Attorney Docket no. 5001A-228), an electronic control and ignition system may be implemented with the firing system of the present invention, including a programmable controller that sends an electric firing signal only if safe and authorized firing conditions, or other programmed conditions, are satisfied. The electronic control system may be adapted for use with other types of non-impact energy ignited primers.

In the preferred embodiment, the grip (14) receives an ammunition magazine (26), a primary battery (15), a module (28) containing a microcontroller, and electronic circuitry. An authorization device, preferably in the form of a fingerprint scanner (29), is located on the grip (14). After a fingerprint signal or other type of predetermined authorization signal is delivered to the microcontroller, a determination is made by the microcontroller to enable or disable firing. Firing is enabled when the conditions are met to establish a predetermined firing ready state. The microcontroller can be programmed to execute other pre-firing routines as prerequisites to firing, such as component status testing or security code entry, as disclosed in co-pending Patent Application No. (Attorney Docket no. 5001A-228). The microcontroller can be programmed to operate in various modes, such as sleep mode and fire-ready mode, depending upon signals received by the controller from one or more sensors. A visually perceptible display screen can be used to indicate various modes and functions.

When a firing readiness signal is transmitted from the controller, the ignition system converts low level dc input from the battery source to a firing pulse of a minimum of 150 vdc, or other voltage level as required by the ammunition being used, for a sufficient duration to cause the ammunition primer (44) to ignite. The electric firing signal is transmitted from the controller through circuitry connected to the battery and causes the firing pulse to be discharged in square wave form from a capacitor which retains stored energy. The duration of the pulse is preferably about 1 millisecond. The controller is programmed to prohibit a subsequent firing signal for a duration of about 100–150 milliseconds to avoid inadvertent firing that may occur from recoil, trigger hesitation or other unintentional conditions. The typical firearm operator cannot intentionally shoot faster than about 200 milliseconds between rounds, so the 150 millisecond cycle time provides an adequate safety measure without affecting performance.

Figure 6:
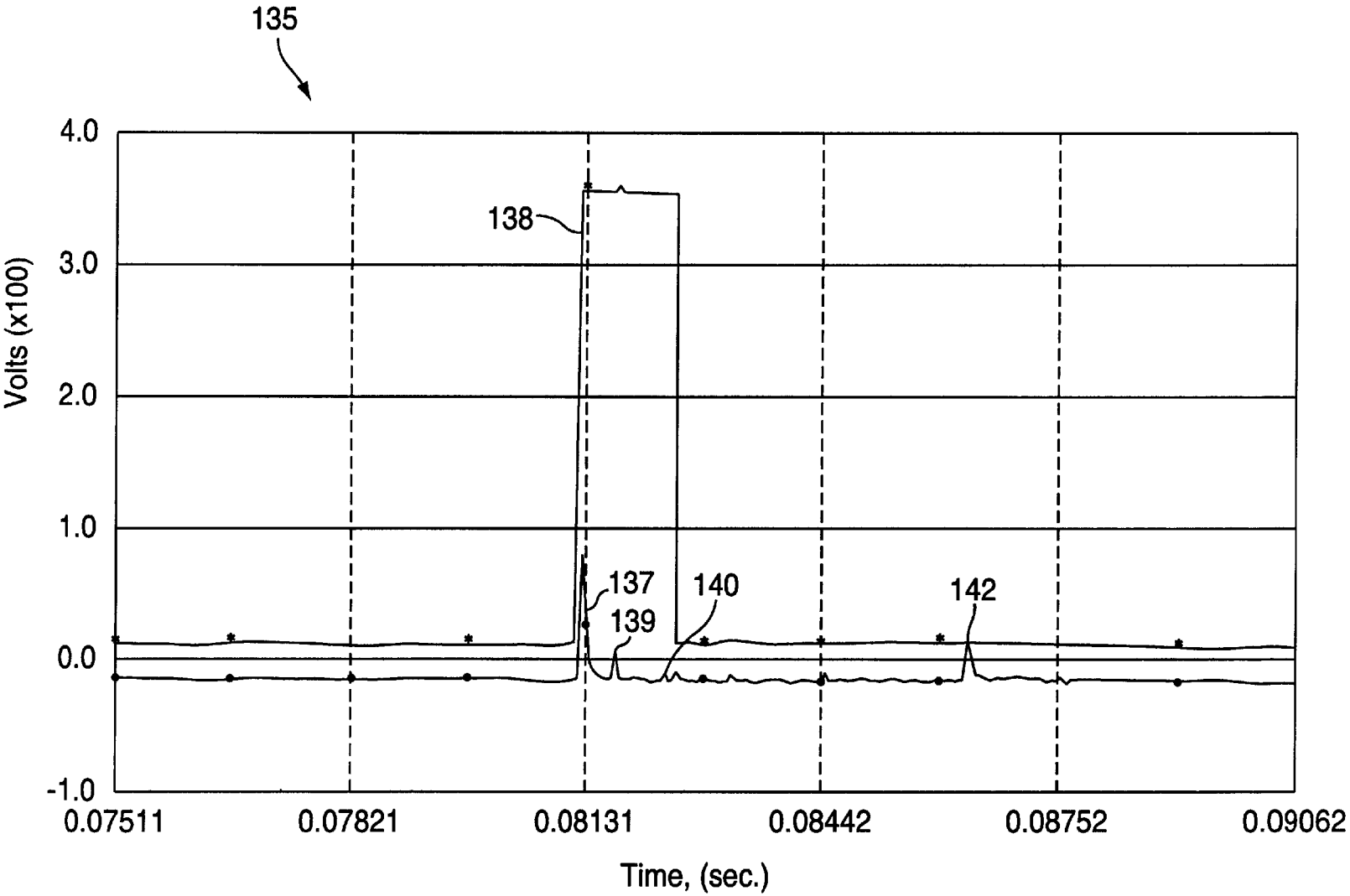
FIG. 6 is a graph illustrating the firing signal and firing impulse according to the present invention, plotting voltage against time.

A graph (135) shown in FIG. 6 depicts the timing of the firing signal (137) as it is received by the controller from the trigger system (20), and the square wave firing impulse (138) discharged from the capacitor and delivered from the ignition probe (50) to the ammunition primer (44). As shown in the graph (135), a local maximum peak representing the firing signal (137) coincides in time with the initiation of square wave firing pulse (138). As can be seen, incidental peaks (139, 140, 142) in the firing signal generation means occur very quickly, in less than 100 milliseconds, after initiating the firing pulse (138). Such incidental peaks (139, 140, 142) occur due to recoil and vibration. Thus, it is important to implement control programming to prohibit inadvertent firing due to signals generated from vibration and recoil. By establishing a predetermined minimum signal magnitude and by implementing successive firing signaling within a predetermined time cycle, inadvertent firing can be prohibited.

Figure 7:
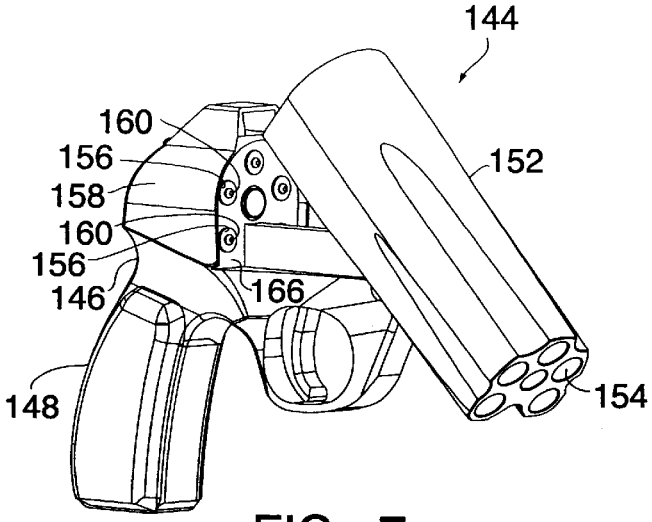
FIG. 7 is a schematic, front perspective view of a second embodiment of the present invention firing system implemented in a multiple-chamber handgun.
Figure 8:
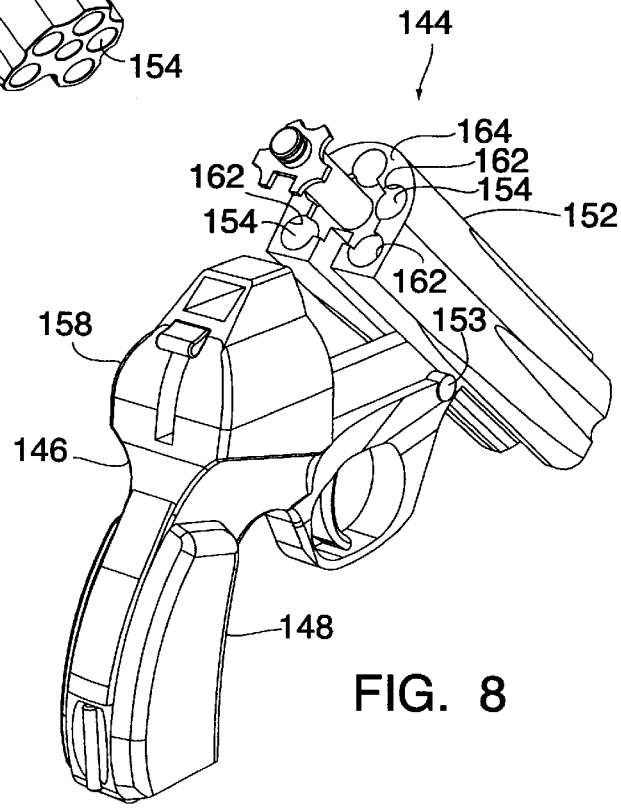
FIG. 8 is a schematic, rear perspective view the multiple-chamber handgun illustrated in FIG. 7.

Another embodiment of the present invention is illustrated in FIGS. 7–8, and includes a firing control system and non-impact ignition probe arrangement similar to that described above with respect to the first embodiment, but implemented with a multiple chamber handgun. By way of example, a multiple chamber handgun (144), comprises a frame (146) having a grip (148), and a barrel (152) having a plurality of longitudinal bores (154) from which ammunition rounds are fired.

The multiple chamber handgun(144) includes a plurality of non-impact ignition probes (156) of the type described above with respect to the first embodiment. The ignition probes (156) each correspond to one of the longitudinal bores (154) and are adapted to ignite corresponding ammunition rounds. The ignition probes (156) are housed in the upper rear portion (158) of the frame (146) and are each positioned so that their respective tips (160) are aligned with and adapted to contact respective ammunition primers of loaded ammunition rounds.

The barrel (152) of the multiple chamber handgun (144) is pivoted about a pivot pin (153) to an open position to accommodate loading or unloading. The longitudinal bores (154) extend all the way back so that they form openings (162) on the rear internal face (164) of the barrel (152) into which ammunition rounds are directly loaded. When loaded, the ammunition rounds are positioned within the longitudinal bores (154) so that their rear faces protrude slightly beyond the rear internal face (164) of the barrel (152).

The ignition probes (156) have tips (160) formed on them, as described with respect to the first embodiment, and are retained in the rear section (158) of the frame (146) in such as way as to allow the tips (160) to protrude past the front, internal wall (166) of the frame (146). Because the ignition probes (156) are spring-biased in the axial direction, in a manner similar to that described with respect to the first embodiment, they are adapted to contact the rear faces of the loaded ammunition rounds when the barrel (152) is pivoted to the closed position. The ignition probe tips (160) extend far enough to contact the beveled rear edges of the ammunition rounds so that the ignition probe tips (160) are deflected by the beveled edges in a camming action, to bias the ignition probes (156) rearwardly. When the barrel (152) is fully shut, the ignition probe tips (160) are centered with respect to the ammunition round rear faces in a manner similar to that described with respect to the first embodiment.

While the ignition probes (156) are in contact with the ammunition rounds, the control system delivers a firing charge to ignite each ammunition round. As described with respect to the first embodiment, the control system is programmed to make pre-firing determinations prior to signaling for release of a firing charge from a power source. In the multiple chamber handgun (144), the control system operates in a manner similar to and performs the same functions as the firing control system as described with respect to the first embodiment.

Figure 10:
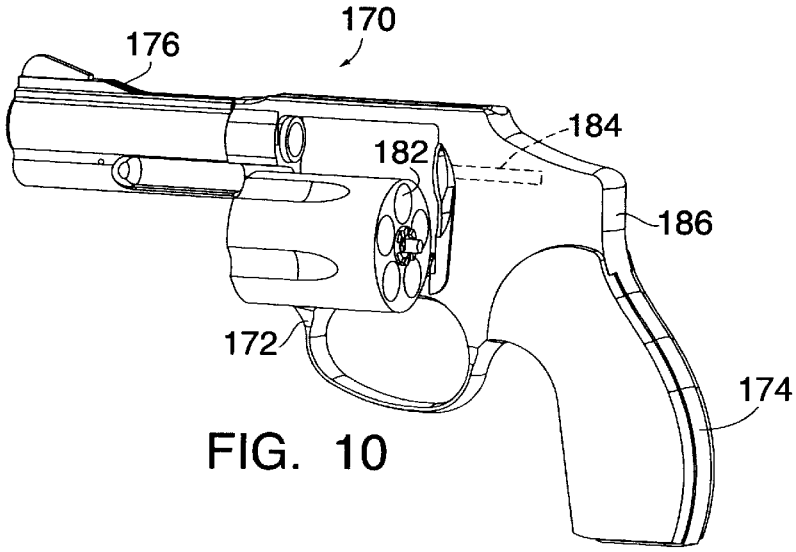
FIG. 10 is a schematic, partial rear perspective view of the revolver illustrated in FIG. 9, shown in an opened cylinder position.
Figure 9:
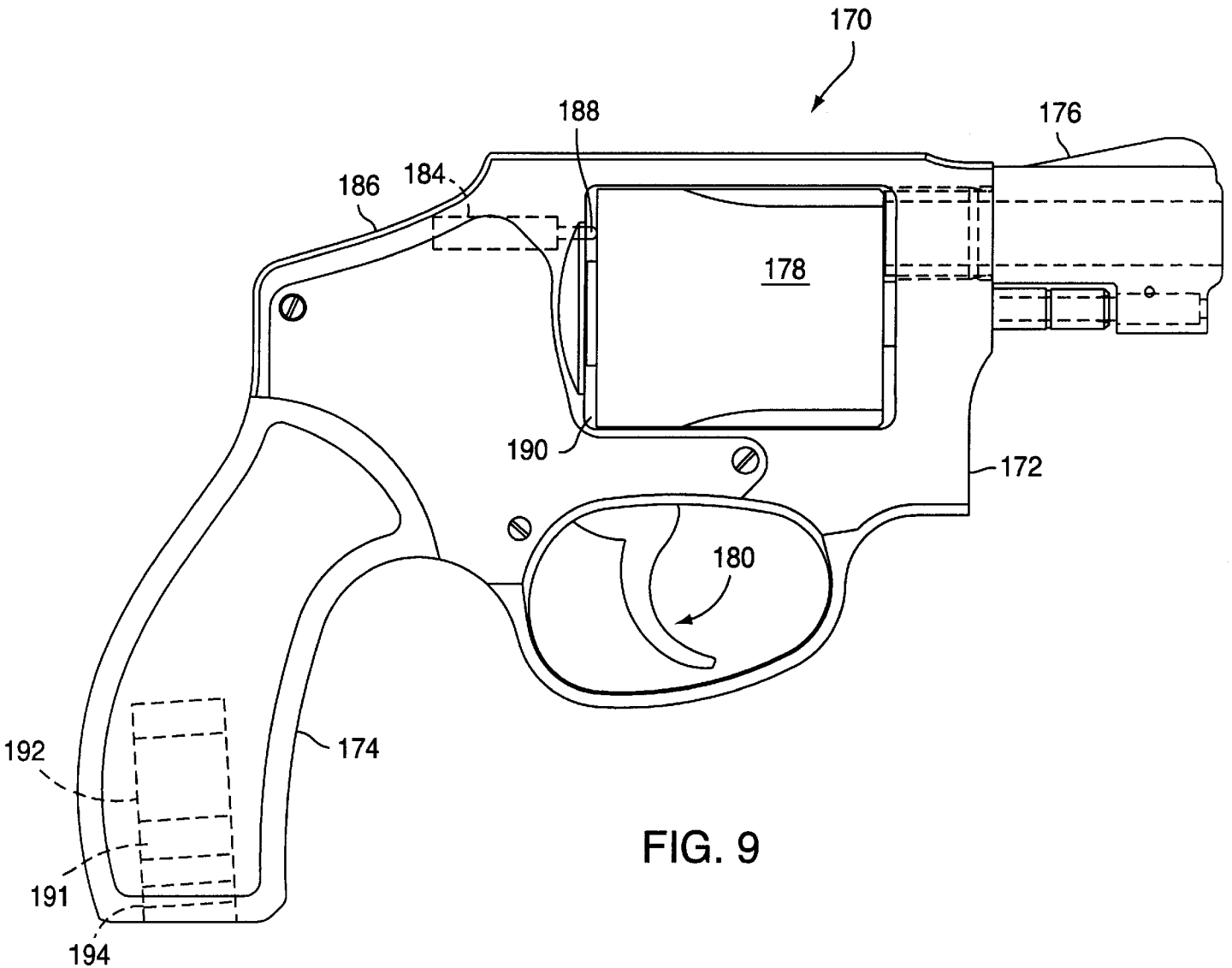
FIG. 9 is a schematic, cross-sectional side view of a third embodiment of the present invention firing system implemented in a revolver.

Another embodiment of the present invention firearm control system and non-impact ignition primer is directed to a revolver (170), as shown in FIGS. 9–10. The revolver (170) comprises a frame (172), a grip (174), a barrel (176), a cylinder (178), and a trigger (180). As in conventional revolvers, the cylinder (178) has multiple, horizontally aligned internal ammunition chambers (182) that are each adapted to guide a fired ammunition round out through the barrel (176). The cylinder (178) is rotatable to move an ammunition chamber (182) into alignment with the barrel (176). The ammunition chambers (182) extend the entire length of the cylinder (178) so that they have open ends at both front and rear. As in conventional revolvers, the cylinder (178) pivots laterally out from the frame (172) for loading and unloading of the ammunition chambers (182), as shown in FIG. 10. Ammunition rounds are loaded into the ammunition chambers (182) from the rear open ends. After the loaded cylinder (178) is pivoted into a closed position, as shown in FIG. 9, an ammunition chamber (182) aligns with the barrel and a non-impact ignition probe (184), shown in phantom, that is located internally within the rear end (186) of the frame (172) so that the tip of the probe aligns with the ammunition round held in the ammunition chamber (182).

As discussed with respect to the first embodiment, the ignition probe (184) is similarly mounted within the frame (172) of the revolver (170) to enable spring biasing in the forward direction. The ignition probe tip (188) protrudes slightly past the internal forward wall (190) of the frame (172) to ensure contact with a loaded ammunition round. The ammunition rounds are loaded in such a way so that their rear surfaces protrude slightly behind the cylinder (178) to allow the ignition probe tip (188) to engage in a camming fashion the rear beveled edge of an ammunition round being moved into a firing position. Once the ammunition round is positioned, the ignition probe tip (188) engages the center of the rear surface of the ammunition round.

The firing control system comprises a microcontroller (191), shown in phantom lines, that can be housed in the grip (174) or another portion of the frame (172). If desired, the microcontroller (191) may be housed in a removable module (192) that is received in the grip (174). A battery (194) is also housed in the grip (174) and may be contained in the module (192) as shown.

As described above, the control system according to each embodiment delivers a firing charge to ignite an ammunition round. The control system is programmed to make pre-firing determinations prior to signaling for release of the firing charge from the power source. Additional operational, diagnostic and security functions may be programmed into the controller.

While the preferred embodiment of the present invention has been herein disclosed and described, it is acknowledged that variation and modification can be made without departing from the scope of the present invention.

What is claimed is:

1. A non-impact firing apparatus for a semi-automatic gun adapted to utilize ammunition cartridges each having a non-impact primer adjacent one end thereof, said gun including a frame, a movable slide assembly, a power source and a control module for selectively permitting a firing command signal to issue from said power source, said non-impact firing apparatus comprising:

an ammunition chamber formed in said movable slide having a breech face adjacent one end thereof, said chamber being adapted to releasably house said ammunition cartridge so that said non-impact primer is oriented adjacent to said breech face when said cartridge is in a firing position;

an electrically conductive ignition probe housed within said movable slide, said probe including a tip portion at a distal end thereof wherein said tip portion is constantly biased to protrude beyond an opening in said breech face a predetermined distance into said chamber;

a trigger assembly mounted within said frame, wherein actuation of said trigger assembly enables electrical communication between said probe and said power source, thereby initiating detonation of said non-impact primer and subsequent firing of said cartridge; and wherein said trigger assembly comprises a pivotable trigger lever and a translatable trigger bar wherein operation of said trigger lever causes said trigger bar to contact a switching device, thereby initiating communication of said firing command signal to said probe.

2. A non-impact firing apparatus for a semi-automatic gun according to claim 1, wherein:

said trigger lever is pivotable about a first pin fixed to said frame;

said trigger bar is pivotably fixed to said trigger lever wherein operation of said trigger lever produces an approximately rectilinear movement of said trigger bar; and said switching device includes at least two switches to reduce the possibility of unintended actuation of said switching device by said trigger bar.

3. A non-impact firing apparatus for a semi-automatic gun according to claim 2, wherein:

said approximately rectilinear movement of said trigger bar occurs in a direction approximately parallel to a movement of said movable slide.

4. A non-impact firing apparatus for a semi-automatic gun according to claim 1, wherein:

said control module comprises a portion of an electronic control and ignition system which operates to monitor and control an operation of said non-impact firing apparatus; and said electronic control and ignition system includes an electrical ground in electrical communication with said frame.

5. A non-impact firing apparatus for a semi-automatic gun according to claim 4, wherein:

said electrical ground is comprised of a spring biased electrically conductive plunger which extends through a bore formed in said movable slide to contact said frame.

6. A non-impact firing apparatus for a semi-automatic gun according to claim 1, wherein:

said non-impact firing apparatus further includes an electrically insulating sleeve housed within said movable slide, said insulating sleeve being adapted to accommodate said probe therein;

said probe includes a first portion and a second portion, said first portion having a larger cross sectional area than said second portion wherein said second portion extends beyond said insulating sleeve; and said tip portion is formed adjacent a distal end of said second portion.

7. A non-impact firing apparatus for a semi-automatic gun according to claim 6, wherein:

said insulating sleeve further includes first and second closed ends, wherein said first closed end has an aperture formed therethrough; and said second portion protrudes through said aperture.

8. A non-impact firing apparatus for a semi-automatic gun according to claim 7, wherein:

an insulating bushing is disposed between said first closed end and said breech face; and said insulating bushing having a centrally oriented bore for allowing passage of said second portion through said bore and said opening in said breech face.

9. A non-impact firing apparatus for a semi-automatic gun according to claim 7, wherein:

a biasing spring is disposed within said insulating sleeve and biases said probe in a first direction so that said tip portion protrudes a predetermined distance through said breech face into said chamber; and said biasing spring permitting said probe to be deflected in a second direction approximately opposite to said first direction, wherein said biasing spring ensures that said tip portion maintains electrical communication with said non-impact primer when said cartridge is in said firing position.

10. A non-impact firing apparatus for a semi-automatic gun according to claim 9, wherein:

said probe is deflected in said second direction by said cartridge when said cartridge is introduced to said ammunition chamber.

11. A non-impact firing apparatus for a semi-automatic gun according to claim 6, wherein:

said insulating sleeve further comprises an electrically insulating extension, said insulating extension adapted to house a conductor member in electrical communication with said probe and said control module; and said conductor member enabling communication of said firing command signal from said power source to said probe.

12. A non-impact firing apparatus for a semi-automatic gun according to claim 11, wherein:

said insulating extension is oriented adjacent a distal end of said insulating sleeve;

said conductor member including a first telescoping portion and a second telescoping portion which are spring biased relative to one another; and one of said first and second telescoping portions being spring biased to contact said first portion of said probe and the other of said first and second telescoping portions being spring biased to maintain electrical communication with said power source.

13. A non-impact firing apparatus for a semi-automatic gun according to claim 7, wherein:

said second closed end is formed as an electrically insulating end cap and is adapted for mating engagement with said insulating sleeve;

a circuit board assembly is oriented adjacent said end cap and is adapted to be in electrical communication with said probe, said circuit board assembly including an electrically insulating extension adapted to house a conductor member in electrical communication with said circuit board assembly and said control module; and said conductor member enabling communication of said firing command signal from said power source to said probe.

14. A non-impact firing apparatus for a semi-automatic gun according to claim 13, wherein:

said insulating extension is oriented adjacent a distal end of said circuit board assembly; and said conductor member is spring biased to maintain electrical communication with said power source.

15. A non-impact firing apparatus for a semi-automatic gun according to claim 1, wherein:

said power source comprises a battery.

16. A non-impact firing apparatus for a semi-automatic gun according to claim 1, wherein:

said power source comprises a battery in electrical communication with a capacitive device; and said capacitive device being capable of discharging said firing command signal in response to actuation of said trigger assembly.

17. A non-impact firing apparatus for a semi-automatic gun according to claim 16, wherein:

said firing command signal is an electrical pulse having a predetermined duration; and said control module prohibiting subsequent discharges of said firing command signal for a predetermined time period after said capacitive device discharges said firing command signal.

18. A non-impact firing apparatus for a semi-automatic gun according to claim 17, wherein:

said predetermined duration is approximately 1 millisecond; and said predetermined time period is approximately 100 to approximately 150 milliseconds.

19. A non-impact firing apparatus for a semi-automatic gun adapted to utilize ammunition cartridges each having a non-impact primer adjacent one end thereof, said gun including a frame, a movable slide assembly, a power source and a control module for selectively permitting a firing command signal to issue from said power source, said non-impact firing apparatus comprising:

an ammunition chamber formed in said movable slide having a breech face adjacent one end thereof, said chamber being adapted to releasably house said ammunition cartridge so that said non-impact primer is oriented adjacent to said breech face when said cartridge is in a firing position;

an electrically conductive ignition probe housed within said movable slide, said probe including a tip portion at a distal end thereof wherein said tip portion is constantly biased via a longitudinal bore formed in said ignition probe to protrude beyond an opening in said breech face a predetermined distance into said chamber; and a trigger assembly mounted within said frame, wherein actuation of said trigger assembly enables electrical communication between said probe and said power source, thereby initiating detonation of said non-impact primer and subsequent firing of said cartridge.

20. A non-impact firing apparatus for a semi-automatic gun adapted to utilize ammunition cartridges each having a non-impact primer adjacent one end thereof, said gun including a frame, a movable slide assembly, a power source and a control module for selectively permitting a firing command signal to issue from said power source, said non-impact firing apparatus comprising:

an ammunition chamber formed in said movable slide having a breech face adjacent one end thereof, said chamber being adapted to releasably house said ammunition cartridge so that said non-impact primer is oriented adjacent to said breech face when said cartridge is in a firing position;

an electrically conductive ignition probe housed within said movable slide, said probe including a tip portion at a distal end thereof wherein said tip portion is constantly biased to protrude beyond an opening in said breech face a predetermined distance into said chamber;

a trigger assembly mounted within said frame, wherein actuation of said trigger assembly enables electrical communication between said probe and said power source, thereby initiating detonation of said non-impact primer and subsequent firing of said cartridge; and wherein said control module comprises a portion of an electronic control and ignition system which operates to monitor and control an operation of said non-impact firing apparatus, said electronic control and ignition system including an electrical ground comprised of a spring biased electrically conductive plunger which extends through a bore formed in said movable slide to contact said frame.

21. A non-impact firing apparatus for a semi-automatic gun adapted to utilize ammunition cartridges each having a non-impact primer adjacent one end thereof, said gun including a frame, a movable slide assembly, a power source and a control module for selectively permitting a firing command signal to issue from said power source, said non-impact firing apparatus comprising:

an ammunition chamber formed in said movable slide having a breech face adjacent one end thereof, said chamber being adapted to releasably house said ammunition cartridge so that said non-impact primer is oriented adjacent to said breech face when said cartridge is in a firing position;

an electrically conductive ignition probe housed within said movable slide, said probe including a tip portion at a distal end thereof wherein said tip portion is constantly biased to protrude beyond an opening in said breech face a predetermined distance into said chamber;

a trigger assembly mounted within said frame, wherein actuation of said trigger assembly enables electrical communication between said probe and said power source, thereby initiating detonation of said non-impact primer and subsequent firing of said cartridge;

an electrically insulating sleeve housed within said movable slide, said insulating sleeve being adapted to accommodate said probe therein and includes first and second closed ends, wherein said first closed end has an aperture formed therethrough;

said probe includes a first portion and a second portion, said first portion having a larger cross sectional area than said second portion wherein said second portion extends through said aperture and beyond said insulating sleeve; and wherein said tip portion is formed adjacent a distal end of said second portion.

* * * * *